US012660861B2

(12) United States Patent
Cho et al.

(10) Patent No.: US 12,660,861 B2
(45) Date of Patent: Jun. 23, 2026

(54) AEROSOL GENERATING DEVICE AND OPERATION METHOD THEREOF

(71) Applicant: KT&G CORPORATION, Daejeon (KR)

(72) Inventors: Byung Sung Cho, Gyeonggi-do (KR); Min Kyu Kim, Daejeon (KR); Won Kyeong Lee, Gyeonggi-do (KR); Jong Sub Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 765 days.

(21) Appl. No.: 17/427,768

(22) PCT Filed: Aug. 24, 2020

(86) PCT No.: PCT/KR2020/011241
§ 371 (c)(1),
(2) Date: Aug. 2, 2021

(87) PCT Pub. No.: WO2021/060716
PCT Pub. Date: Apr. 1, 2021

(65) Prior Publication Data

US 2022/0125124 A1 Apr. 28, 2022

(30) Foreign Application Priority Data

Sep. 25, 2019 (KR) ..... 10-2019-0118382

(51) Int. Cl.
*A24F 40/60* (2020.01)
*A24F 40/46* (2020.01)
(Continued)

(52) U.S. Cl.
CPC ..... *A24F 40/60* (2020.01); *A24F 40/46* (2020.01); *A24F 40/50* (2020.01); *A24F 40/51* (2020.01); *A24F 40/53* (2020.01); *A24F 40/57* (2020.01)

(58) Field of Classification Search
None
See application file for complete search history.

(56) References Cited

U.S. PATENT DOCUMENTS 9,067,029 B2 6/2015 Yamada et al.
9,949,507 B2 4/2018 Flick
(Continued)

FOREIGN PATENT DOCUMENTS

CN 110198642 A 9/2019
JP 2014-530632 A 11/2014
(Continued)

OTHER PUBLICATIONS

Extended European Search Report Date Jan. 21, 2022 in European Application No. 20867098.4.
(Continued)

*Primary Examiner* — Michael H. Wilson
*Assistant Examiner* — Michael T Fulton
(74) *Attorney, Agent, or Firm* — Sughrue Mion, PLLC

(57) ABSTRACT

Provided is an aerosol generating device including: a heater configured to heat an aerosol-generating material; a battery configured to supply power to the heater; a puff detection sensor configured to detect a user's puff; and a controller configured to receive a sensing value from the puff detection sensor, wherein the controller is configured to, when the sensing value is equal to or less than a first threshold value, determine that a puff has occurred and control power supplied to the heater based on a first temperature profile for a pre-set time period, and after the pre-set time period, control
(Continued)

power supplied to the heater based on a second temperature profile.

6 Claims, 9 Drawing Sheets

(51) Int. Cl.

| | |
|---|---|
| ***A24F 40/50*** | (2020.01) |
| ***A24F 40/51*** | (2020.01) |
| ***A24F 40/53*** | (2020.01) |
| ***A24F 40/57*** | (2020.01) |

(56) References Cited

U.S. PATENT DOCUMENTS

| | | | | |
|---|---|---|---|---|
| 10,111,465 | B2 | 10/2018 | Liu | |
| 10,247,443 | B2 | 4/2019 | Flick | |
| 2014/0000638 | A1* | 1/2014 | Sebastian | A24F 40/30 131/328 |
| 2014/0299141 | A1 | 10/2014 | Flick | |
| 2017/0019951 | A1 | 1/2017 | Louveau et al. | |
| 2017/0095005 | A1* | 4/2017 | Monsees | A24F 40/42 |
| 2018/0146710 | A1 | 5/2018 | Bessant et al. | |
| 2018/0154103 | A1 | 6/2018 | Davis | |
| 2019/0133192 | A1 | 5/2019 | Lord et al. | |
| 2019/0380390 | A1 | 12/2019 | Jeong et al. | |
| 2020/0046033 | A1 | 2/2020 | Robert et al. | |
| 2021/0068456 | A1 | 3/2021 | Bessant et al. | |

FOREIGN PATENT DOCUMENTS

| | | | |
|---|---|---|---|
| JP | 2018-518264 | A | 7/2018 |
| KR | 10-2009-0023742 | A | 3/2009 |
| KR | 10-2014-0090160 | A | 7/2014 |
| KR | 10-2014-0094513 | A | 7/2014 |
| KR | 10-1863934 | B1 | 6/2018 |
| KR | 10-2019-0038181 | A | 4/2019 |
| KR | 10-2019-006080 | A | 6/2019 |
| KR | 10-2019-0070940 | A | 6/2019 |
| WO | 2008/015918 | A1 | 2/2008 |
| WO | 2017/045899 | A1 | 3/2017 |
| WO | 2017/144191 | A1 | 8/2017 |
| WO | 2018/202403 | A1 | 11/2018 |

OTHER PUBLICATIONS

Office Action issued Mar. 31, 2023, in Chinese Application No. 202080018700.7.

Korean Office Action for 10-2019-0118382 dated, Feb. 23, 2021.

International Search Report for PCT/KR2020/011241 dated, Mar. 5, 2021 (PCT/ISA/210).

Written Opinion of the International Searching Authority for PCT/KR2020/011241 dated, Mar. 5, 2021 (PCT/ISA/237).

Notice of Reasons for Refusal dated Oct. 18, 2022 from the Japanese Patent Office in JP Application No. 2021-553162.

* cited by examiner

AEROSOL GENERATING DEVICE AND OPERATION METHOD THEREOF

TECHNICAL FIELD

The present disclosure relates to an aerosol generating device and an operation method thereof.

BACKGROUND ART

Recently, the demand for alternatives to traditional cigarettes has increased. For example, there is growing demand for a device for generating an aerosol by heating an aerosol generating material, rather than by combusting cigarettes.

An aerosol generating device detects a user's puff, and controls a heater based on the detection result. On the other hand, puff strength varies according to each user or each puff, and an appropriate atomization amount may vary according to the puff strength.

Accordingly, there is a need for a technique capable of generating appropriate atomization according to puff strength.

DISCLOSURE

Technical Solution

A first aspect of the present disclosure provides an aerosol generating device including: a heater configured to heat an aerosol-generating material; a battery configured to supply power to the heater; a puff detection sensor configured to detect a user's puff; and a controller configured to receive a sensing value from the puff detection sensor, wherein the controller is configured to: receive a sensing value from the puff detection sensor; control power supplied to the heater based on a first temperature profile for a pre-set time period in response to the sensing value becoming equal to or less than a first threshold value, and control the power supplied to the heater based on a second temperature profile after the pre-set time period.

A second aspect of the present disclosure provides a method including: receiving a sensing value from a puff detection sensor; controlling power supplied to a heater based on a first temperature profile for a pre-set time period in response to the sensing value becoming equal to or less than a first threshold value; and controlling the power supplied to the heater based on a second temperature profile after the pre-set time period.

A third aspect of the present disclosure provides a non-transitory computer-readable recording medium having recorded thereon a program for executing the method according to the second aspect on a computer.

Advantageous Effects

In the present disclosure, sufficient vapor may be generated even in the early stage of smoking by supplying power to the heater based on the first temperature profile regardless of the puff strength for a pre-set time period after each puff is detected.

In addition, in the present disclosure, by controlling power to be supplied to the heater based on a customized temperature profile according to the puff strength, atomization may be optimized for a strong puff or a weak puff.

BEST MODE

Figure 1:
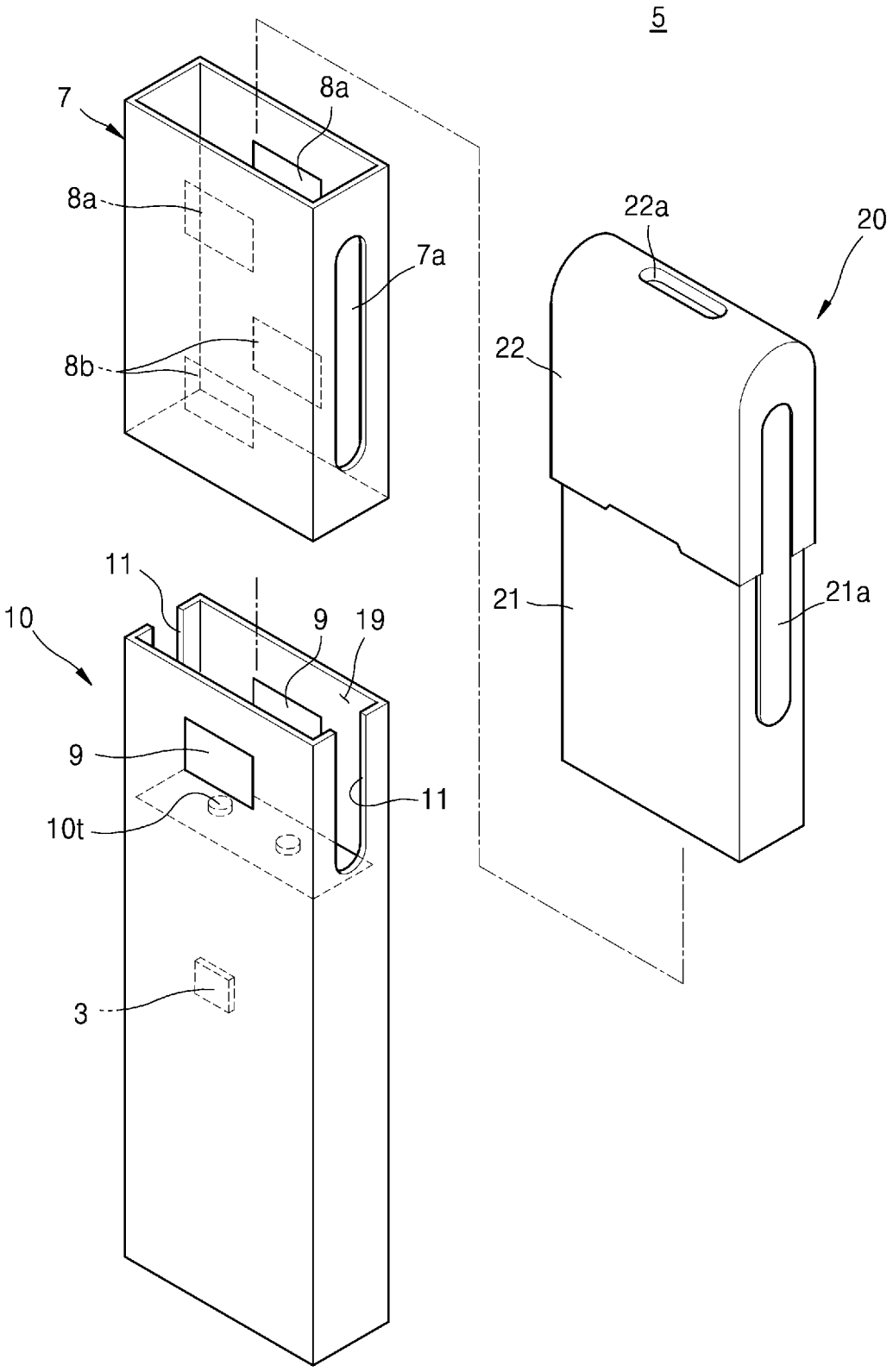
FIG. 1 is an exploded perspective view schematically illustrating a coupling relationship between a replaceable cartridge containing an aerosol generating material and an aerosol generating device including the same, according to an embodiment.

An aerosol generating device includes: a heater configured to heat an aerosol-generating material; a battery configured to supply power to the heater; a puff detection sensor configured to detect a user's puff; and a controller configured to receive a sensing value from the puff detection sensor; control power supplied to the heater based on a first temperature profile for a pre-set time period in response to the sensing value becoming equal to or less than a first threshold value, and control the power supplied to the heater based on a second temperature profile after the pre-set time period.

Mode for Invention

With respect to the terms used to describe the various embodiments, general terms which are currently and widely used are selected in consideration of functions of structural elements in the various embodiments. However, meanings of the terms can be changed according to intention, a judicial precedence, the appearance of new technology, and the like. In addition, in certain cases, terms which are not commonly used may be selected. In such a case, the meanings of the terms will be described in detail at the corresponding portions in the following description of the embodiments. Therefore, the terms used in the various embodiments should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

Hereinafter, embodiments of the present disclosure will now be described more fully with reference to the accompanying drawings so that one of ordinary skill in the art may easily work the present disclosure. The disclosure may, however, be embodied in many different forms and should not be construed as being limited to the embodiments set forth herein.

Hereinafter, the embodiments of the present disclosure will be described in detail with reference to the accompanying drawings.

FIG. 1 is an exploded perspective view schematically illustrating a coupling relationship between a replaceable cartridge containing an aerosol generating material and an aerosol generating device including the same, according to an embodiment.

An aerosol generating device 5 according to the embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 may be inserted into an accommodation space 19 of the main body 10 so that the cartridge 20 may be coupled to the main body 10.

The cartridge 20 may contain an aerosol generating material in any one of, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include one component of water, solvents, ethanol, plant extracts, spices, flavorings, and vitamin mixtures, or a mixture of these components. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. In addition, the liquid composition may include an aerosol forming agent such as glycerin and propylene glycol.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine. Nicotine may be a naturally generated nicotine or synthetic nicotine and may have any suitable weight concentration relative to the total solution weight of the liquid composition.

Acid for the formation of the nicotine salts may be appropriately selected in consideration of the rate of nicotine absorption in the blood, the operating temperature of the aerosol generating device 5, the flavor or savor, the solubility, or the like. For example, the acid for the formation of nicotine salts may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid or malic acid, or a mixture of two or more acids selected from the group, but is not limited thereto.

The cartridge 20 is operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material, using, for example, an ultrasonic vibration method or an induction heating method. In an embodiment, the cartridge 20 may include its own power source and generate aerosol based on an electric control signal or a wireless signal received from the main body 10.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material and that the liquid storage 21 includes therein an element containing an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

At least a portion of the liquid storage 21 of the cartridge 20 may include a transparent portion so that the aerosol generating material accommodated in the cartridge 20 may be visually identified from the outside. The liquid storage 21 includes a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*. The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 in such a way that the slider 7 may move along the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* may be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted to face each other with the accommodation space 19 therebetween.

Depending on the position of the slider 7, an end of the mouthpiece 22 is covered or exposed by a magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and may generate a signal based on the detected change.

In the aerosol generating device 5 according to the above-described embodiments, the main body 10, the cartridge 20, and the slider 7 have approximately rectangular cross-sectional shapes when the cutting plane is transverse to the longitudinal direction. However, embodiments are not limited thereto. For example, the aerosol generating device 5 may have a cross-sectional shape of a circle, an ellipse, a square, or various polygonal shapes. In addition, the aerosol generating device 5 is not necessarily limited to a structure that extends linearly in the longitudinal direction. For example, the aerosol generating device 5 may have a streamlined shape or may be partially bent to be easily held by the user.

Figure 2:
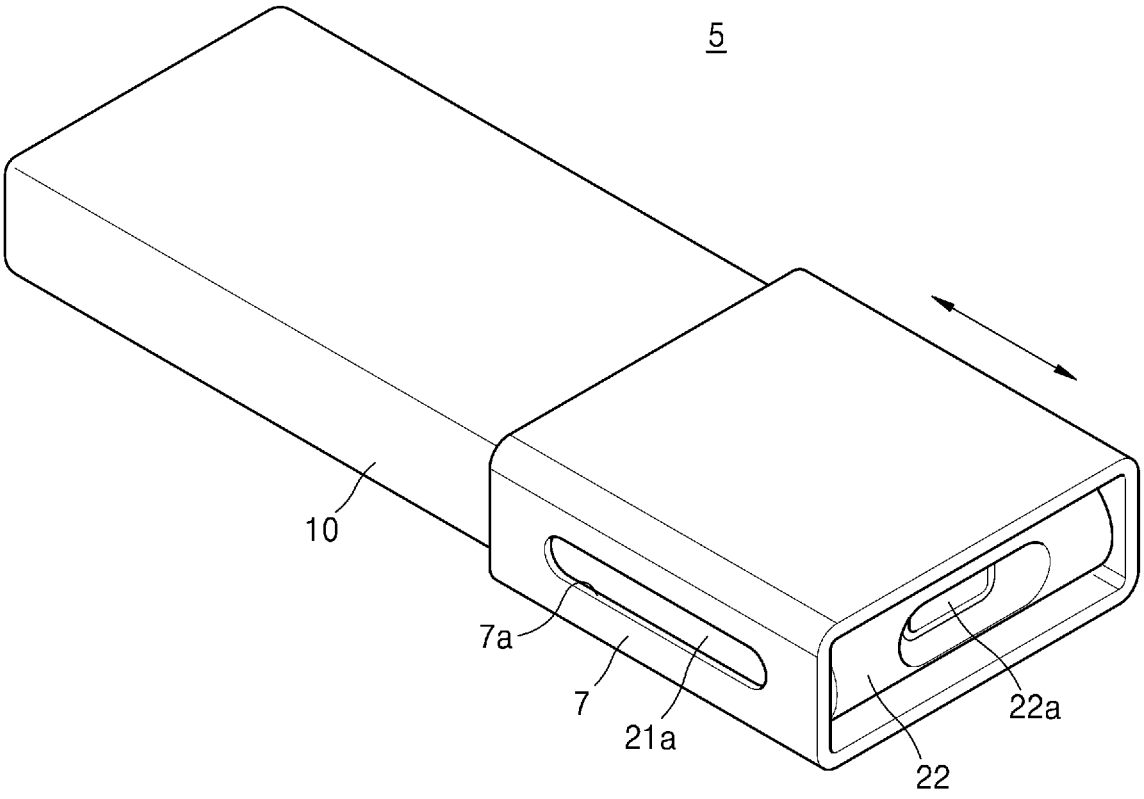
FIG. 2 is a perspective view of an example operating state of the aerosol generating device according to the embodiment illustrated in FIG. 1.

FIG. 2 is a perspective view of an example operating state of the aerosol generating device according to the embodiment illustrated in FIG. 1.

As shown in FIG. 2, the slider 7 is at the position where the end of the mouthpiece 22 is covered by the slider 7. As such, the mouthpiece 22 may be safely protected from external impurities and kept clean.

The user may check the remaining amount of aerosol generating material contained in the cartridge by visually checking the protruding window 21*a* of the cartridge through the elongated hole 7*a* of the slider 7. The user may move the slider 7 in the longitudinal direction of the main body 10 to use the aerosol generating device 5.

Figure 3:
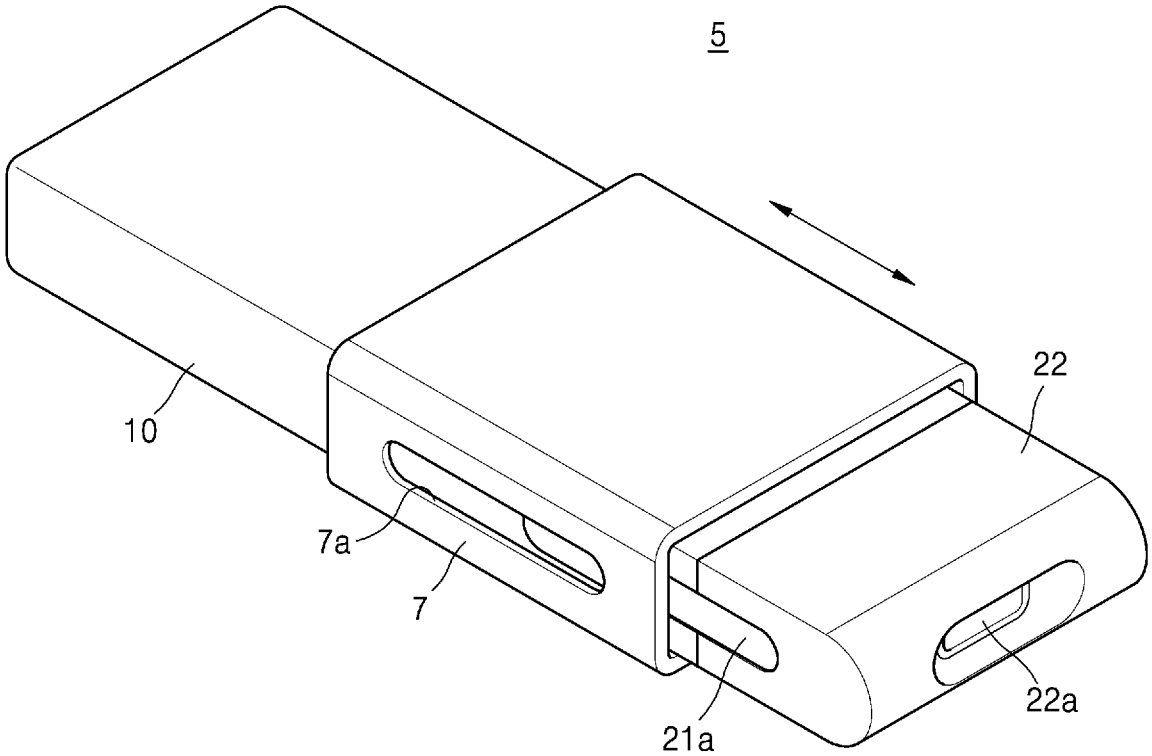
FIG. 3 is a perspective view of another example operating state of the aerosol generating device according to the embodiment illustrated in FIG. 1.

FIG. 3 is a perspective view of another example operating state of the aerosol generating device according to the embodiment illustrated in FIG. 1.

In FIG. 3, the operating state is shown in which the slider 7 is moved to a position where the end of the mouthpiece 22 of the cartridge coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge is still exposed to the outside through the elongated hole 7*a* of the slider 7 when the slider 7 is moved to the position where the end of the mouthpiece 22 is exposed to the outside. Thus, the user may visually check the remaining amount of aerosol generating material contained in the cartridge, regardless of the position of the slider 7.

Figure 4:
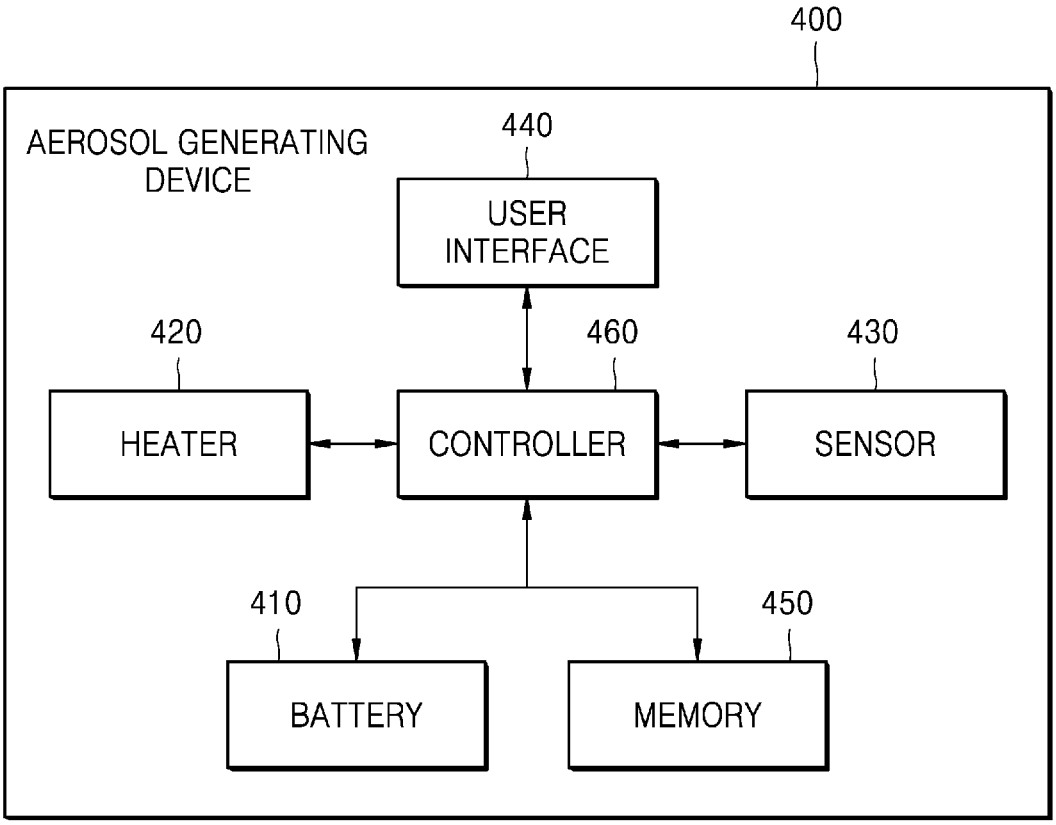
FIG. 4 is a block diagram illustrating hardware components of the aerosol generating device according to an embodiment.

FIG. 4 is a block diagram illustrating hardware components of the aerosol generating device according to an embodiment.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. According to the design of the aerosol generating device 400, it will be understood by one of ordinary skill in the art that some of the hardware components shown in FIG. 4 may be omitted or new components may be added.

In an embodiment, the aerosol generating device 400 may only include a main body without a cartridge. In this case, the components of the aerosol generating device 400 may be located in the main body. In another embodiment, the aerosol generating device 400 may include a main body and a cartridge, in which case the components of the aerosol generating device 400 may be distributed between the main body and the cartridge. Also, at least some of the components of the aerosol generating device 400 may be located in both the main body and the cartridge. Hereinafter, an operation of each of the components will be described without limiting the location of each component.

The battery 410 supplies electric power to be used for the aerosol generating device 400 to operate. In other words, the battery 410 may supply power such that the heater 420 may be heated. In addition, the battery 410 may supply power required for operation of other hardware components included in the aerosol generating device 400, such as the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat a cigarette inserted into the aerosol generating device 400, or heat the cartridge coupled to the aerosol generating device 400.

The heater 420 may be located in the main body of the aerosol generating device 400. Alternatively, when the aerosol generating device 400 consists of the main body and the cartridge, the heater 420 may be located in the cartridge. When the heater 420 is located in the cartridge, the heater 420 may receive power from the battery 410 located in at least one of the main body and the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto. In an embodiment, the heater 420 may be a component included in the cartridge. The cartridge may include the heater 420, the liquid delivery element, and the liquid storage. The aerosol generating material accommodated in the liquid storage may be absorbed and transferred by the liquid delivery element, and the heater 420 may heat the aerosol generating material absorbed by the liquid delivery element, thereby generating aerosol. For example, the heater 420 may include a material such as nickel or chromium and may be wound around or arranged adjacent to the liquid delivery element.

In another embodiment, the heater 420 may heat the cigarette inserted into the accommodation space of the aerosol generating device 400. As the cigarette is accommodated in the accommodation space of the aerosol generating device 400, the heater 420 may be located inside and/or outside the cigarette. Accordingly, the heater 420 may generate aerosol by heating the aerosol generating material in the cigarette.

Meanwhile, the heater 420 may include an induction heater. The heater 420 may include an electrically conductive coil for heating a cigarette or the cartridge by an induction heating method, and the cigarette or the cartridge may include a susceptor which may be heated by the induction heater.

The aerosol generating device 400 may include at least one sensor 430. A sensing result from the at least one sensor 430 is transmitted to the controller 460, and the controller 460 may control the aerosol generating device 400 to perform various functions such as controlling the operation of the heater, restricting smoking, determining whether a cigarette (or a cartridge) is inserted, and displaying a notification, according to the sensing result.

For example, the at least one sensor 430 may include a puff detecting sensor. The puff detecting sensor may detect a user's puff based on any one of a temperature change, a flow change, a voltage change, and/or a pressure change.

In addition, the at least one sensor 430 may include a temperature sensor. The temperature sensor may detect a temperature at which the heater 420 (or an aerosol generating material) is heated. The aerosol generating device 400 may include a separate temperature sensor for sensing a temperature of the heater 420, or the heater 420 itself may serve as a temperature sensor instead of including a separate temperature sensor. Alternatively, a separate temperature sensor may be further included in the aerosol generating device 400 while the heater 420 also serves as a temperature sensor.

In addition, the at least one sensor 430 may include a position change detecting sensor. The position change detecting sensor may detect a change in a position of the slider that is movably coupled to the main body to move with respect to the main body.

The user interface 440 may provide the user with information about the state of the aerosol generating device 400. The user interface 440 may include various interfacing devices, such as a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and communication interfacing modules for performing wireless communication (for example, Wi-Fi, Wi-Fi direct, Bluetooth, near-field communication (NFC), etc.) with external devices. However, the aerosol generating device 400 may be implemented by selecting only some of the above-described various interfacing devices.

The memory 450 may store data processed or to be processed by the controller 460. The memory 450 may include various types of memories, such as random access memory, such as dynamic random access memory (DRAM), static random access memory (SRAM), etc., read-only memory (ROM), electrically erasable programmable read-only memory (EEPROM), etc.

The memory 450 may store an operation time of the aerosol generating device 400, the maximum number of puffs, the current number of puffs, at least one temperature profile, data on a user's smoking pattern, etc.

The controller 460 may control overall operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 4600 analyzes a sensing result of the sensing by at least one sensor 430, and controls subsequent processes that are to be performed subsequently.

The controller 460 may control power supplied to the heater 420 so that the operation of the heater 420 is started or terminated, based on the sensing result of the at least one sensor 430. In addition, based on the sensing result from the at least one sensor 430, the controller 460 may control the amount of power supplied to the heater 420 and the time at which the power is supplied, so that the heater 420 is heated to a predetermined temperature or maintained at an appropriate temperature.

In an embodiment, the aerosol generating device 400 may have a plurality of modes. For example, the modes of the aerosol generating device 400 may include a preheating mode, an operation mode, an idle mode, and a sleep mode. However, the modes of the aerosol generating device 400 are not limited thereto.

When the aerosol generating device 400 is not used, the aerosol generating device 400 may maintain a sleep mode, and the control unit 406 may control the output power of the battery 410 so that power is not supplied to the heater 420 in the sleep mode. For example, the aerosol generating device 400 may operate in a sleep mode before or after use of the aerosol generating device 400.

The controller 460 sets the mode of the aerosol generating device 400 to the preheating mode (e.g., switches from the sleep mode to the preheating mode) to start the operation of the heater 420 after receiving a user input to the aerosol generating device 400.

In addition, the controller 460 may switch a mode of the aerosol generating device 400 from the preheating mode to a heating mode after detecting a user's puff by using the puff detection sensor. In addition, when the operating time of the aerosol generating device 400 in the heating mode reaches a predetermined time, the controller 460 may switch the mode of the aerosol generating device 400 from the heating mode to the idle mode.

In addition, the controller 460 may stop supplying power to the heater 420 when the number of puffs counted by the puff detecting sensor reaches the maximum number of puffs.

A temperature profile corresponding to each of the preheating mode, the operating mode, and the idle mode may be set. The controller 406 may control power supplied to the heater based on the power profile for each mode so that the aerosol-generating material is heated according to the temperature profile for each mode.

The controller 460 may control the user interface 440 based on the result of the sensing by the at least one sensor 430. For example, when the number of puffs counted by the puff detecting sensor reaches a preset number, the controller 460 may notify the user by using at least one of a lamp, a motor or a speaker that the aerosol generating device 400 will be terminated soon.

Figure 5A:
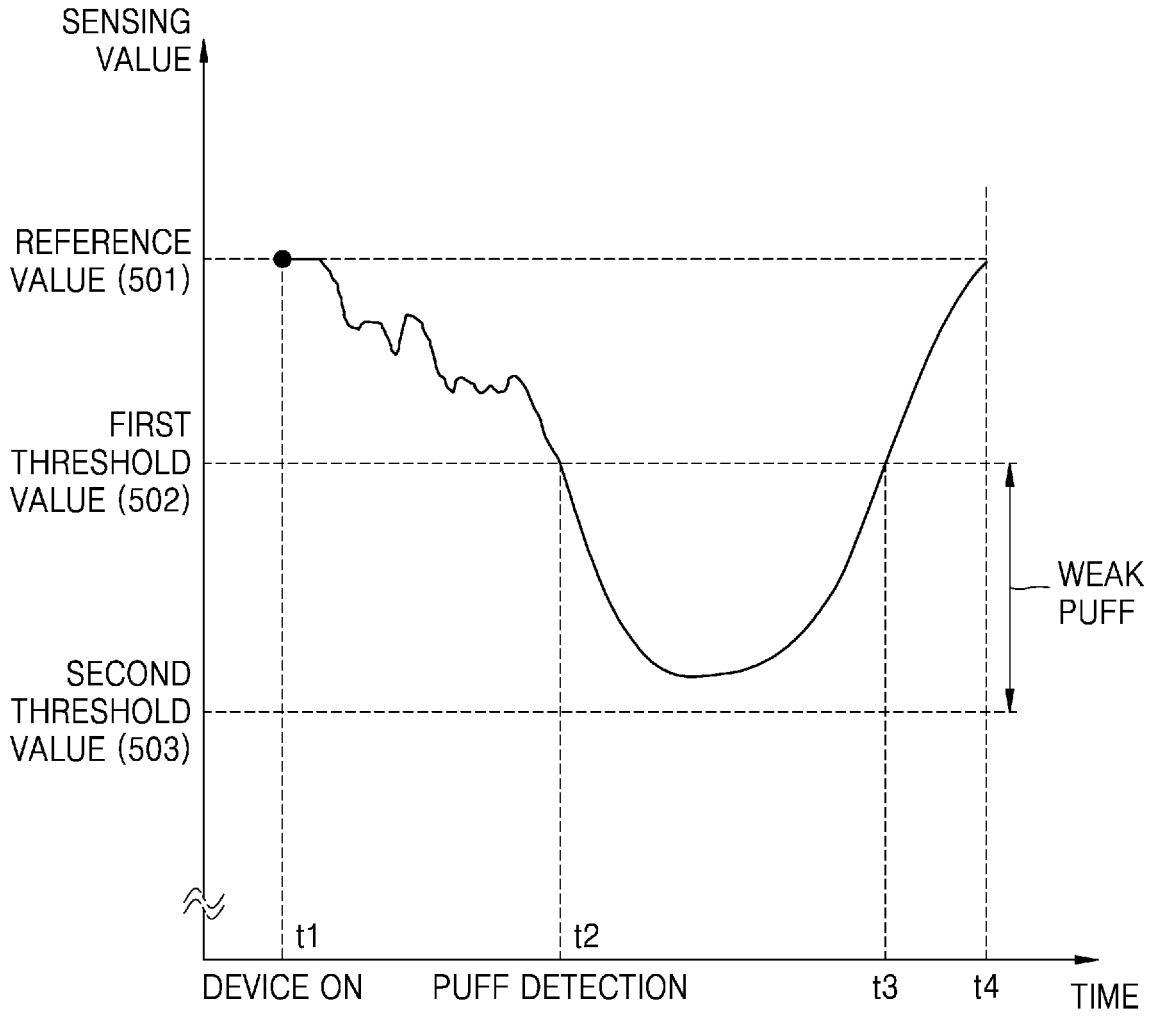
FIGS. 5A and 5B are examples of graphs showing changes in sensing values over time in an embodiment.
Figure 5B:
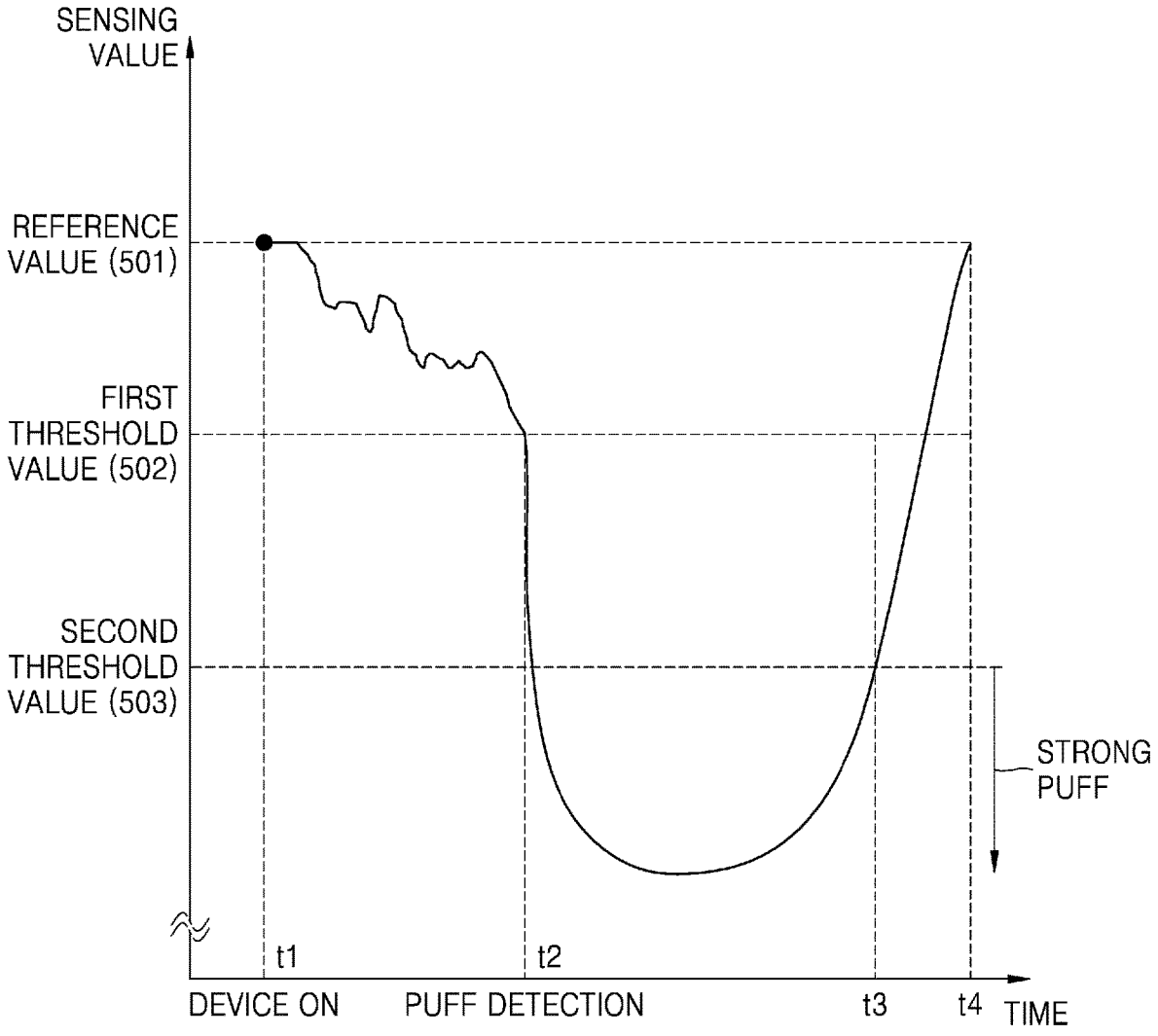

Although not illustrated in FIG. 4, an aerosol generating system may be configured by the aerosol generating device 400 and a separate cradle. For example, the cradle may be used to charge the battery 410 of the aerosol generating device 400. For example, the aerosol generating device 400 may be supplied with power from a battery of the cradle to charge the battery 410 of the aerosol generating device 400 while being accommodated in an accommodation space of the cradle. FIGS. 5A and 5B are examples of graphs showing sensing values that change over time in an embodiment.

An aerosol generating device includes a heater configured to heat an aerosol-generating material, a battery configured to supply power to the heater, a puff detection sensor configured to detect a user's puff, and a controller that is configured to control overall operations of the aerosol generating device.

When a user input is received, the controller may initiate operation of the aerosol generating device. For example, the controller may initiate the operation of the aerosol-generating device in response to receiving user input through interfacing means (e.g., a button or a touch screen).

Referring to FIGS. 5A to 5B, the controller may receive a user input to the aerosol generating device and initiate the operation of the aerosol-generating device at a time point t1. For example, the controller may initiate preheating of the heater by switching from a sleep mode to a preheating mode at t1.

The puff detection sensor may detect a use's puff based on the pressure inside the aerosol generating device. In an embodiment, the controller may set the sensing value (e.g., the pressure inside the aerosol generating device) detected by the puff detection sensor when the operation of the aerosol generating device is started as a reference value 501. That is, the reference value 501 may differ according to atmospheric pressure conditions around the aerosol generating device. For example, when the operation of the aerosol generating device is started in a high altitude region, the reference value 501 may be set lower than when the operation of the aerosol generating device is started in a low altitude region.

The reference value 501 may be used as a basis for setting a first threshold value 502 and a second threshold value 503 which will be described below. For example, the first threshold value 502 may be set to a value corresponding to 80% of the reference value 501, and the second threshold value 503 may be set to a value corresponding to 50% of the reference value 501. However, the method of setting the first threshold value 502 and the second threshold value 503 is not limited to the above-described example.

When the sensing value received from the puff detection sensor by the controller is equal to or less than the first threshold value 502, the controller may determine that a puff has occurred by the user. Referring to FIGS. 5A and 5B, the sensing value decreased to the first threshold value 502 at a time point t2, so the controller may determine that a puff has occurred by the user at t2.

In an embodiment, if the sensing value received from the puff detection sensor by controller becomes lower than or equal to the first threshold value 502 and then the sensing value increases to greater than or equal to the first threshold value 502 after a predetermined time (i.e., within a certain time period after the sensing value becomes lower than or equal to the first threshold value 502), the controller may determine that the puff by the user has been ended. Referring to FIGS. 5A to 5B, the sensing value decreases to the first threshold value 502 at t2. After a predetermined time, the sensing value increases to the first threshold value 502 at a time point t3, so the controller may determine that the puff by the user has been ended.

In another embodiment, when the sensing value received from the puff detection sensor by controller becomes lower than or equal to the first threshold value 502 and then the sensing value increases to the reference value 501 after a predetermined time, the controller may determine that the puff by the user has been ended. Referring to FIGS. 5A to 5B, the sensing value decreases below the first threshold value 502 at t2, and after a predetermined time, the sensing value increases to the reference value 501 at a time point t4. In this case, the controller may determine that the puff by the user has been ended.

The stronger the puff strength of the user is, the more air is leaked from the inside of the aerosol generating device to the outside, which makes the sensing value detected by the puff detection sensor smaller.

FIG. 5A is a graph showing a change in sensing value over time when the user takes a weak puff. If the sensing value detected by the puff detection sensor is maintained between the first threshold value 502 and the second threshold value 503, the controller may determine that a weak puff has occurred.

Figure 6A:
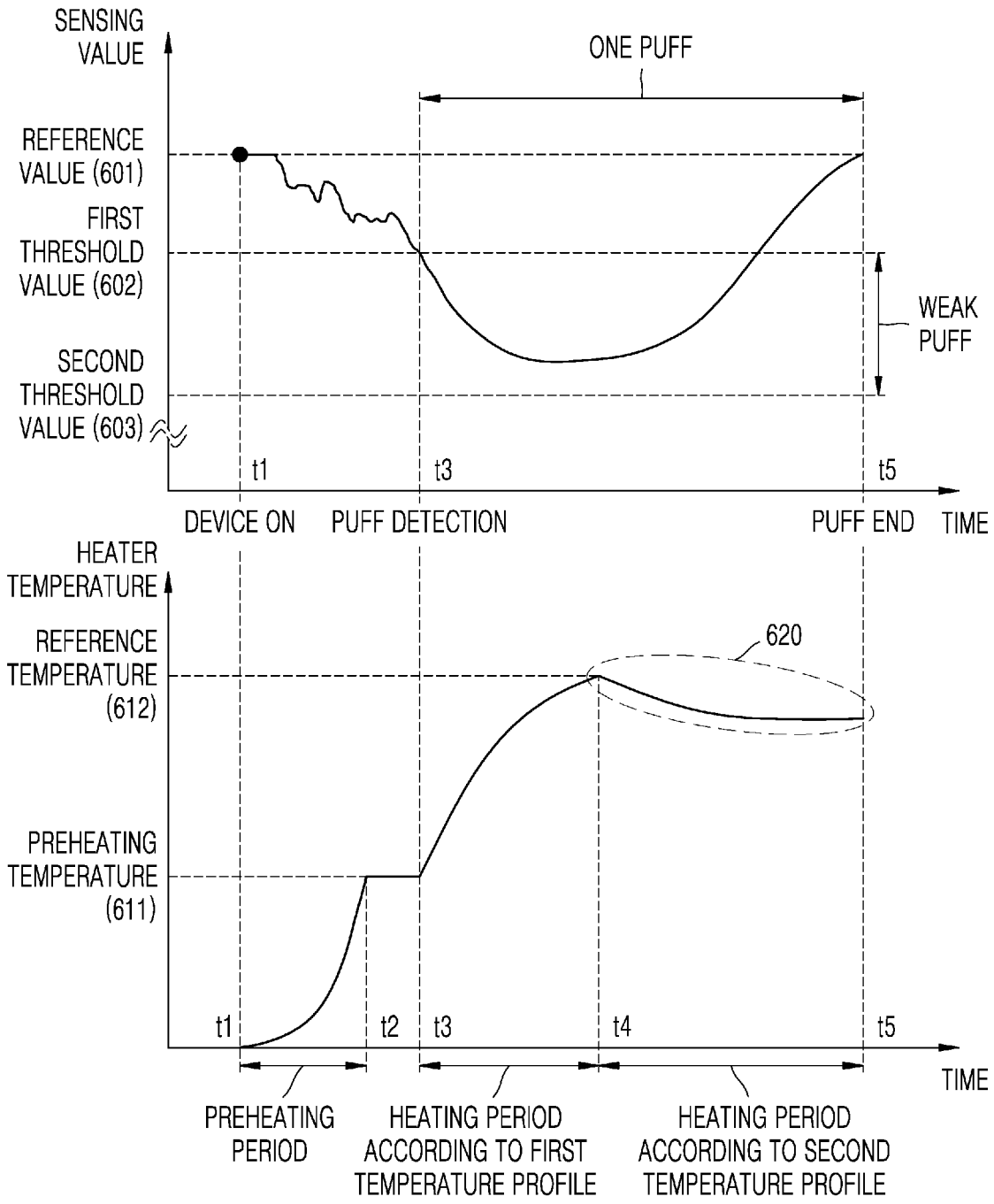
FIGS. 6A and 6B are examples of graphs showing changes in sensing values and temperature over time in an embodiment.
Figure 6B:
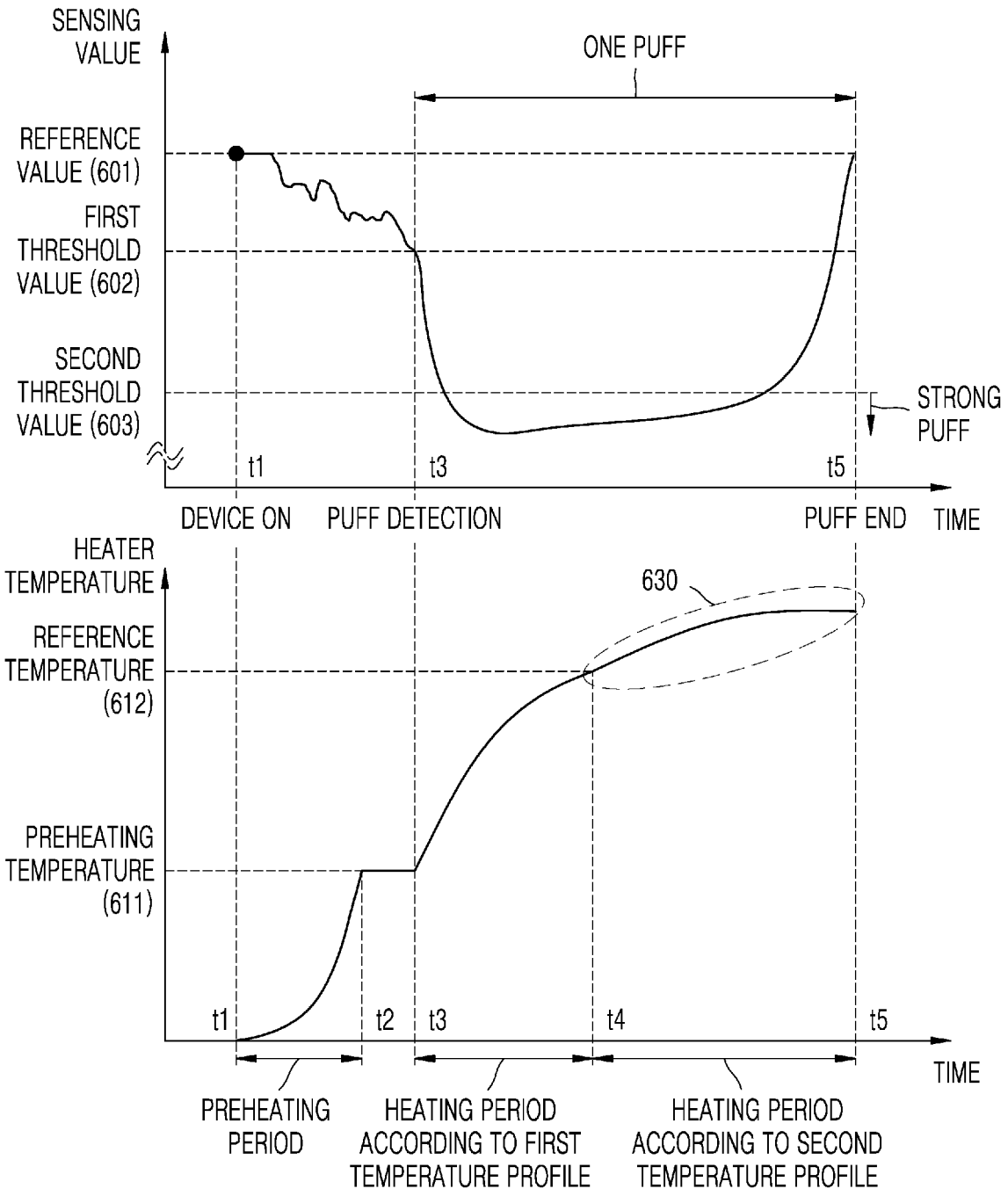

On the other hand, FIG. 5B is a graph showing a change in sensing value over time when the user takes a strong puff. When the sensing value detected by the puff detection sensor becomes less than the second threshold value 503, the controller may determine that a strong puff has occurred. FIGS. 6A and 6B are examples of graphs showing sensing values and temperatures that change over time in an embodiment.

The controller may receive a user input to the aerosol generating device and initiate the operation of the aerosol generating device at a time point t1. For example, the controller may initiate preheating of the heater by switching from a sleep mode to a preheating mode at t1.

In an embodiment, the controller may preheat the heater based on a preheating temperature profile which is pre-set. In a preheating period from t1 to t2, the temperature of the heater may rise to a preheating temperature 611. When the temperature of the heater reaches the preheating temperature 611, the controller may lower the amount of power supplied to the heater or stop supplying of power to the heater for a predetermined time to maintain the temperature of the heater at the preheating temperature 611. For example, the preheating temperature 611 may be a temperature between 50° C. and 100° C., but is not limited thereto.

When the sensing value received from the puff detection sensor by the controller is equal to or less than the first threshold value 602, the controller may determine that a puff has occurred by the user. Referring to FIGS. 6A and 6B, since the sensing value at a time point t3 is equal to or less than the first threshold value 602, the controller may determine that a puff has occurred by the user at t3. When it is determined that the puff has occurred, the controller may control power supplied to the heater based on the first temperature profile for a pre-set time period. The first temperature profile may be determined regardless of the puff strength. In other words, in all cases where a weak puff has occurred or a strong puff has occurred, power supplied to the heater may be controlled based on the same temperature profile (i.e., the first temperature profile) among a plurality of predetermined temperature profiles. For example, the pre-set time period may be 1 second to 5 seconds, preferably 3 seconds, but is not limited thereto.

FIG. 6A is a graph showing a case in which a weak puff has occurred, and FIG. 6B is a graph showing a case in which a strong puff has occurred. In both FIGS. 6A and 6B, the controller may control power supplied to the heater based on the first temperature profile for a pre-set time period t3 to t4 after a puff is detected.

Hereinafter, in both FIGS. 6A and 6B, it is assumed that the temperature of the heater reaches the reference temperature 612 at t4, which is a time point at which a heating period according to the first temperature profile ends. For example, the reference temperature 612 may be 200° C. to 250° C., but is not limited thereto.

In addition, the controller may control power supplied to the heater based on a second temperature profile after the pre-set time period t3 to t4. The second temperature profile may be determined according to the puff strength. That is, the second temperature profile may be configured differently depending on whether a weak puff has occurred or a strong puff has occurred.

In an embodiment, when a strong puff has occurred, the controller may control power supplied to the heater such that the heater is heated to a higher temperature than when a weak puff has occurred. For example, when a weak puff has occurred, the controller may determine the second temperature profile 620 such that the heater is heated to a temperature lower than the reference temperature 612. For example, the controller may select the second temperature profile 620 from among a plurality of predetermined temperature profiles. Referring to FIG. 6A showing a case in which a weak puff has occurred, the second temperature profile 620 of the heater is maintained lower than the reference temperature 612 in a period from t4 to t5. For example, the output power of the battery for heating the heater according to the second temperature profile 620 may be 6 W, but is not limited thereto.

On the other hand, when a strong puff occurs, the controller may determine the second temperature profile 630 such that the heater is heated to a temperature higher than the reference temperature 612. Referring to FIG. 6B showing a case in which a strong puff occurs, the second temperature profile 630 of the heater is maintained higher than the reference temperature 612 in a period from t4 to t5. For example, the output power of the battery for heating the heater according to the second temperature profile 630 may be 7 W, but is not limited thereto.

However, the second temperature profile is not limited to the examples shown in FIGS. 6A to 6B. In an embodiment, when the sensing value received from the puff detection sensor by controller is lower than or equal to the first threshold value 602 and then rises to the reference value 601 after a predetermined time, the controller may determine that the puff by the user has been ended. Referring to FIGS. 6A to 6B, the sensing value at t3 is equal to or less than the first threshold value 602. After a predetermined time (i.e., within a certain time period after t3), the sensing value at a time point t5 rises to the reference value 601, so the controller may determine that the puff by the user has been ended.

However, the time point at which the puff is determined to be ended is not limited to t5. For example, the controller may determine that the puff by the user has ended when the sensing value becomes less than or equal to the first threshold value 602 and then returns to the first threshold value 602 after a predetermined time (i.e., within a certain time period after the sensing value previously reached the first threshold value 602).

Immediately after the puff detection sensor detects the user's puff, the temperature of the heater is not high enough to generate sufficient vapor. Thus, in order to generate sufficient vapor, it is necessary to supply high power to the heater regardless of the strength of the puff by the user. In an embodiment, sufficient vapor may be generated even in the early stage of smoking by supplying power to the heater based on the first temperature profile regardless of the puff strength for a pre-set time period after each puff is detected.

On the other hand, after the temperature of the heater reaches a sufficiently high temperature, it is necessary to change the temperature profile according to the strength of the puff by the user. In other words, in the case of the strong puff, it is necessary to provide more vapor per puff, compared to the case of the weak puff.

In an embodiment, the power supplied to the heater may be controlled, after the pre-set time period (e.g., t3-t4 in FIGS. 6A and 6B), based on the second temperature profile determined according to the puff strength. As such, a large amount of vapor may be provided in the case of the strong puff, and a relatively small amount of atomization may be provided in the case of the weak puff. In other words, by controlling power supplied to the heater differently based on strength of the puff after the pre-set time period, an optimal amount of vapor may be generated.

Although the above-described examples assume only two types of strength degrees (i.e., "strong puff" and "weak puff"), embodiments are not limited thereto. For example, an embodiment may discern more than two degrees of the puff strength, and additional threshold values with respect to the sensing value may be set accordingly to detect the degrees of the puff strength.

Figure 7:
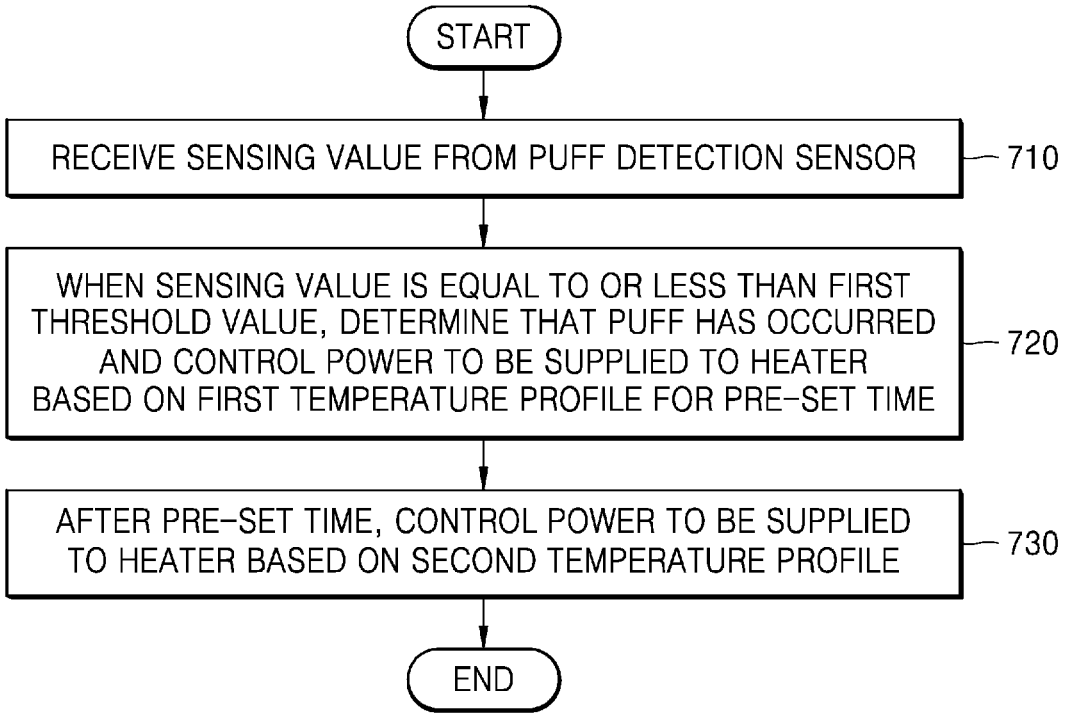
FIG. 7 is a flowchart illustrating a method of controlling an aerosol generating device according to an embodiment.

FIG. 7 is a flowchart illustrating a method of controlling an aerosol generating device according to an embodiment.

Referring to FIG. 7, in operation 710, the aerosol generating device may receive a sensing value from a puff detection sensor.

The puff detection sensor may detect a user's puff based on a change in pressure inside the aerosol generating device. In this case, the sensing value may indicate the pressure inside the aerosol generating device.

The puff detection sensor may set the sensing value detected when the operation of the aerosol generating device is started as a reference value. For example, when the operation of the aerosol generating device is started in a high altitude region, the reference value may be set lower than when the operation of the aerosol generating device is started in a low altitude region where air pressure is lower than the high altitude region.

A first threshold value and a second threshold value, which will be described below, may be set based on the reference value. For example, the first threshold value may be set to a value corresponding to 80% of the reference value, and the second threshold value may be set to a value corresponding to 50% of the reference value.

The aerosol generating device may control power supplied to the heater in response to an input signal for initiating the operation of the heater such that the temperature of the heater reaches a preheating temperature. If the aerosol generating device detects a user's puff by using the puff detection sensor, and it may switch from a preheating mode to a heating mode.

In operation 720, when the sensing value becomes equal to or less than a first threshold value, the aerosol generating device may determine that a puff has occurred and control power supplied to the heater based on a first temperature profile for a pre-set time period.

The first temperature profile may be selected regardless of the puff strength. In other words, whether or not the detected puff is weak or strong, the power may be controlled based on the same temperature profile (i.e., first temperature profile).

For example, the pre-set time period may be 1 second to 5 seconds, preferably 3 seconds, but is not limited thereto.

In operation 730, after the pre-set time period, the aerosol generating device may control power supplied to the heater based on a second temperature profile.

The aerosol generating device may determine that a weak puff has occurred if the sensing value is maintained between the first threshold value and the second threshold value during the pre-set time period. On the other hand, the aerosol generating device may determine that a strong puff has occurred if the sensing value becomes less than the second threshold value at any time during the pre-set time period.

When a strong puff has occurred, the aerosol generating device may control power supplied to the heater such that the heater is heated to a higher temperature than when a weak puff has occurred. Specifically, power is supplied to the heater based on the first temperature profile for the pre-set time period, so that the temperature of the heater may reach the reference temperature. After the pre-set time period, the aerosol generating device may determine (i.e., select) a second temperature profile such that the heater is heated to a temperature lower than the reference temperature when the weak puff is detected during the pre-set time period, and determine the second temperature profile such that the heater is heated to a temperature higher than the reference temperature when the strong puff has detected during the pre-set time period.

An embodiment may also be implemented in the form of a non-transitory computer-readable recording medium including instructions executable by a computer, such as a program module executable by the computer. The non-transitory computer-readable recording medium may be any available medium that can be accessed by a computer and includes both volatile and nonvolatile media, and removable and non-removable media. In addition, the computer-readable medium may include both a computer storage medium and a communication medium. The computer storage medium includes all of volatile and nonvolatile, and removable and non-removable media implemented by any method or technology for storage of information such as computer-readable instructions, data structures, program modules or other data. The communication medium typically includes computer-readable instructions, data structures, other data in modulated data signals such as program modules, or other transmission mechanisms, and includes any information transfer media.

At least one of the components, elements, modules or units (collectively "components" in this paragraph) represented by a block in the drawings such as the controller 460 and the user interface 440 in FIG. 4, may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

What is claimed is:

1. An aerosol generating device comprising:

a heater configured to heat an aerosol generating material;

a battery configured to supply power to the heater;

a puff detection sensor configured to detect a user's puff; and a controller configured to:

receive a sensing value from the puff detection sensor;

control power supplied to the heater based on a first temperature profile for a first time period when the puff is detected in response to the sensing value becoming equal to or less than a first threshold value, to cause a temperature of the heater to reach a reference temperature, the first temperature profile being determined regardless of whether a puff strength is a strong puff or a weak puff;

detect the sensing value representing the puff strength during the first time period;

when the weak puff is detected based on the detected sensing value being maintained between the first threshold value and a second threshold value during the first time period, determine a second temperature profile to control the power supplied to the heater such that the heater is heated to a first target temperature lower than the reference temperature during a second time period; and when the strong puff is detected based on the detected sensing value being less than the second threshold value at any time during the first time period, determine the second temperature profile to control the power supplied to the heater such that the heater is heated to a second target temperature higher than the reference temperature during the second time period, wherein the second target temperature is higher than the first target temperature, and wherein the first time period for the first temperature profile and the second time period for the second temperature profile, which follows the first time period, are pre-set time periods after the puff is detected.

2. The aerosol generating device of claim 1, wherein the second temperature profile is applied subsequent to the first temperature profile after the first time period.

3. The aerosol generating device of claim 1, wherein the controller is further configured to:

detect that the puff strength is the weak puff based on the sensing value representing the puff strength being maintained between the first threshold value and the second threshold value during the first time period, and detect that the puff strength is the strong puff based on the sensing value representing the puff strength being less than the second threshold value at any time during the first time period.

4. The aerosol generating device of claim 3, wherein the controller is further configured to:

in response to the weak puff being detected, determine the second temperature profile applied for a heating of the heater after the first time period as the first target temperature, and in response to the strong puff being detected, determine the second temperature profile as the second target temperature.

5. The aerosol generating device of claim 1, wherein the controller is further configured to control the power supplied to the heater in response to an input signal for initiating operation of the heater, such that the heater is heated to a preheating temperature.

6. The aerosol generating device of claim 1, wherein the puff detection sensor is configured to set the sensing value detected when operation of the aerosol generating device is started as a reference value, and the first threshold value and the second threshold value are set based on the reference value.

* * * * *